United States Patent [19]

Reinfeld

[11] Patent Number: 4,667,832

[45] Date of Patent: May 26, 1987

[54] APPARATUS FOR PROCESSING AND RECOVERY OF THE METAL CONTAINERS FROM TRASH

[76] Inventor: Nyles V. Reinfeld, P.O. Box 2321, Bath, Ohio 44210

[21] Appl. No.: 721,272

[22] Filed: Apr. 8, 1985

[51] Int. Cl.[4] ..... B03C 1/02; B02C 23/10

[52] U.S. Cl. ..... 209/636; 100/91; 100/902; 209/222; 209/229; 209/930; 241/79

[58] Field of Search ..... 209/636, 637, 691, 694, 209/695, 629, 631, 635, 707, 930, 213–215, 222, 223.1, 229, 231; 100/902, 90, 91, 99; 241/79.1, 99, 68, 79

[56] References Cited

U.S. PATENT DOCUMENTS

| | | | |
|---|---|---|---|
| 2,427,774 | 9/1947 | Fredrickson | 209/636 |
| 2,766,887 | 10/1956 | Atwood | 209/636 |
| 3,015,394 | 1/1962 | Woods | 209/222 |
| 3,877,578 | 4/1975 | Morey | 209/636 |
| 4,373,435 | 2/1983 | Grevich | 209/636 X |
| 4,463,844 | 8/1984 | Huffman et al. | 209/213 X |
| 4,483,248 | 11/1984 | Ostreng | 100/902 X |

FOREIGN PATENT DOCUMENTS

| | | | |
|---|---|---|---|
| 1199798 | 12/1959 | France | 209/222 |
| 45-29712 | 9/1970 | Japan | 209/222 |
| 54-71875 | 6/1979 | Japan | 100/902 |

*Primary Examiner*—Robert B. Reeves
*Assistant Examiner*—Edward M. Wacyra
*Attorney, Agent, or Firm*—Oldham, Oldham & Weber Co.

[57] ABSTRACT

A magnetic can separator where a supply device drops crushed cans onto a mechanism that includes a non-magnetic separator disc positioned by a shaft for permitting rotation of the disc at a controlled speed, a plurality of magnetic members secured to the under surface of the disc for attracting magnetic cans and retaining them on the disc, and a guide secured adjacent to and above the top surface of the disc to engage any articles thereon and extending generally radially of the disc offset from its center to engage cans or articles on the upper surface of the disc and as the disc is rotated, the crushed cans are progressively stripped from the upper surface of the disc by the guide whereas the non-magnetic cans are thrown circumferentially from the disc substantially immediately upon deposit thereon. The separator disc can be positioned at an angle of up to about 50 degrees to the horizontal for improved operation.

7 Claims, 3 Drawing Figures

FIG.-2
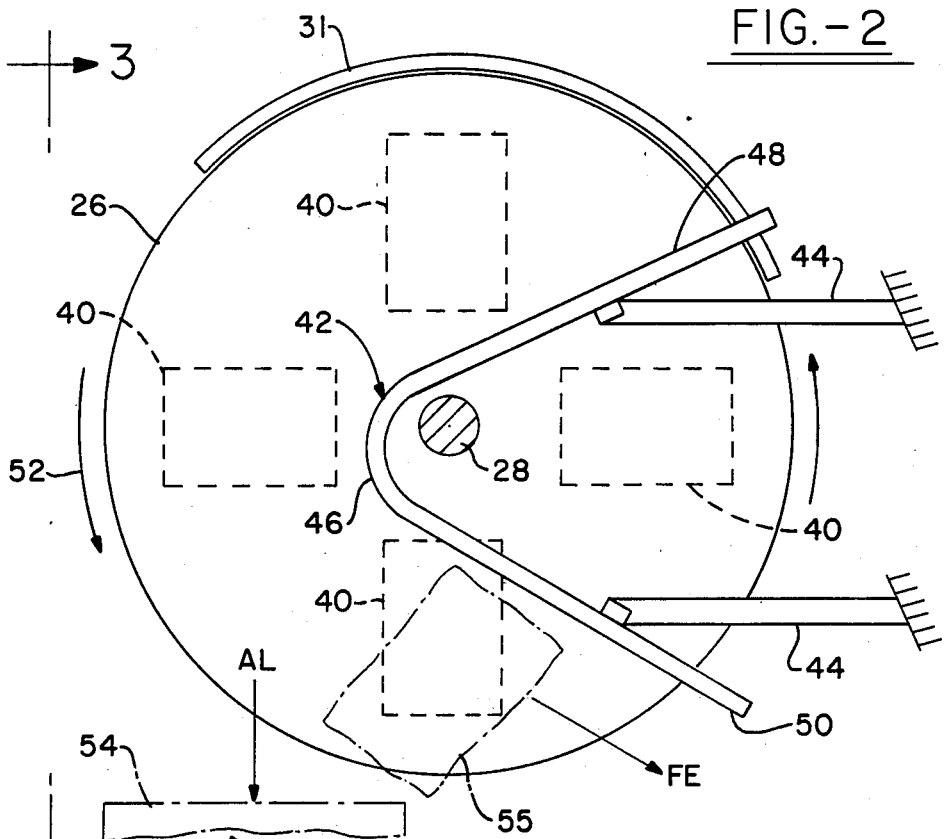
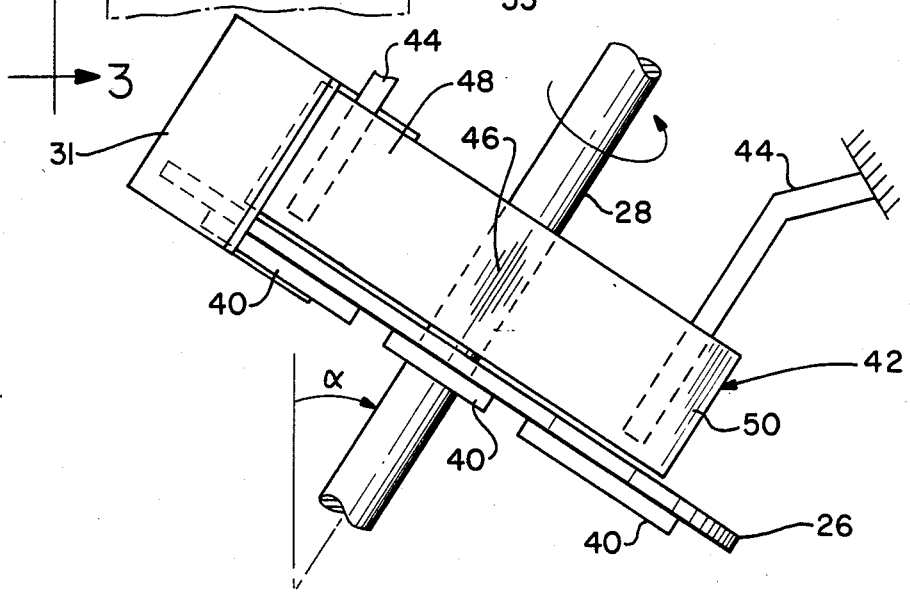
FIG.-3

APPARATUS FOR PROCESSING AND RECOVERY OF THE METAL CONTAINERS FROM TRASH

BACKGROUND ART

The present invention relates to apparatus such as that shown in U.S. Pat. No. 4,179,018 wherein a processing apparatus is shown for selectively crushing both magnetic and non-magnetic cans, and separating the magnetic cans from the non-magnetic cans and then ultimately moving the non-magnetic cans to a weighing and storage area wherein the weight of cans being processed in a given group can be established and, if desired, payment can be made for the processed articles.

A similar construction using a magnetic drum and belt type of a separator for magnetic articles is shown in U.S. Pat. No. 4,257,511. Other drum type magnetic material separators or apparatus therefore is shown in U.S. Pat. Nos. 3,749,240 and 4,225,047. U.S. Pat. No. 4,316,410 is of interest as it relates to a compact can crusher and is of the type that can be used for preparing cans for separation between magnetic material cans and cans made from non-magnetic material.

Some prior separator apparatus has used feeder and/or conveyor belts therein and these belts characteristics vary with the operating temperatures and may require frequent adjustment. Also, conveyor belt equipment is bulky and is relatively slow acting.

DISCLOSURE OF INVENTION

The present invention has as an object the provision of an improved apparatus for separating articles made from magnetic material from articles not made from magnetic materials and particularly for separating steel cans from aluminum cans by an efficient relatively low cost apparatus.

Another object of the invention is to use a rotary disc and a specially positioned guide or stripper bar in association therewith for stripping articles made from magnetic material from a rotary disc having magnet means associated therewith for retaining magnetic materials thereon.

Another object of the invention is to form an improved apparatus for accepting aluminum cans and processing them to gather a group of them together to be weighed, stored or otherwise processed as desired.

Yet another object of the invention is to provide an efficient apparatus that is dependable and which will not jam up or become inoperative even if left without an attendant for appreciable operative times.

The foregoing and other objects and advantages of the invention will be made more apparent as the specification proceeds.

BRIEF DESCRIPTION OF THE DRAWINGS

The foregoing and other objects of the invention are obtained by use of the apparatus shown in the accompanying drawings, wherein

FIG. 2 is an enlarged plan, partially diagramatic, of a rotary disc separator portion of the apparatus of FIG. 1; and FIG. 3 is a fragmentary side elevation of the apparatus of FIG. 2.

When referring to corresponding members shown in the drawings and referred to this specification, corresponding numerals are used to facilitate comparison therebetween.

Figure 1:
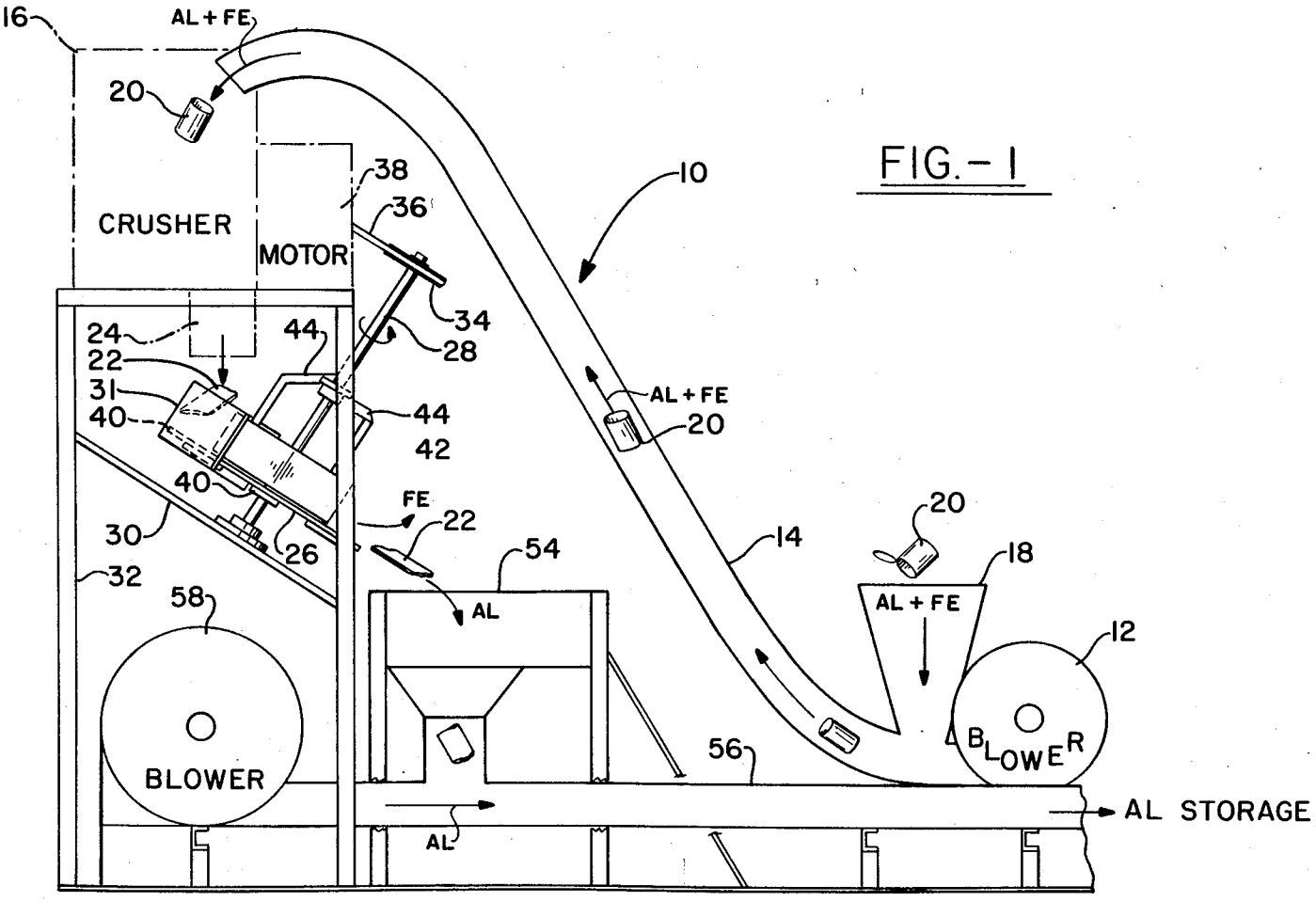
FIG. 1 is a side elevation, partially shown in diagramatic form, of an apparatus for processing cans and for separating magnetic materials from non-magnetic materials.

The magnetic can separator of the invention is adapted to function with means that preferably drop crushed cans, although cans need not be crushed before separation, on to the mechanism and where the mechanism comprises a non-magnetic rotary separator disc having a top and a lower surface, a plurality of magnetic members secured to the under surface of the disc and equally spaced in circumferential relation, a guide means including at least one relatively straight leg portion secured adjacent to and above the top surface of the disc for engaging any cans thereon as the disc is rotated to move articles thereon toward the guide means, which guide means usually has an apex and two diverging legs forming the apex which has the center of the disc included in the angle defined thereby, the said legs extending generally radially of the disc to the periphery of the disc, and means for rotating the disc whereby when cans are deposited onto the disc externally of the guide means and its apex, the non-magnetic cans are thrown therefrom substantially immediately and deposited in a basket for weighing or otherwise and the magnetic cans move with the disc but are progressively stripped therefrom by the guide members and especially one of the diverging legs of such guide means, and deposited in a container or trash bin.

BEST MODE FOR CARRYING OUT INVENTION

Reference now is particularly directed to the details of the structure shown on the accompanying drawings, and an apparatus indicated as a whole by the numeral 10 is provided for separating aluminum cans from cans made from a magnetic material, i.e. iron. This apparatus 10 may be associated with any other conventionally known means or storage chamber device, as desired. The unit particularly includes a blower 12 that connects to a transfer chute 14 that extends up to the crusher 16 which is of any conventional manufacturer or design. Articles to be processed can be suitably deposited into a housing provided around the blower 10 and/or be deposited into a drop chute 18 associated therewith and which drops the articles into the chute at about where it connects to the blower.

The articles such as cans 20 move rapidly upwardly in the chute 14 and then they usually would be deposited into the crusher mechanism 16 for the cans 20 and which can be similar to that shown in the aforementioned U.S. Pat. No. 4,179,018. In all events, crushed cans 22 are released through a discharge chute 24 for deposit on to the novel apparatus of the present invention for separating the magnetic material cans from the non-magnetic material cans. Thus, such can separating apparatus includes a separator disc 26 that is made from non-magnetic material and which is operatively positioned by a shaft 28 which is in turn operatively positioned on a plate or bar 30 that forms a portion of a frame 32 for this can separating apparatus. The shaft 28, as best shown in the drawing, can be journaled by and supported on a suitable means on the bar 30 and such shaft extends up out of the frame 32 and normally would carry a member such as a pulley 34 at the end thereof. The pulley 34 in turn engages a drive belt 36 that extends to any conventional member such as a motor 38 for driving or rotating the separator disc 26 at a controlled rate of speed. Any suitable bearings or other journal members can be used to aid in operatively positioning the shaft 28. The angle the shaft 28 makes with the vertical, which is indicated as being the angle alpha in FIG. 3, is made to a suitable angle such as from 0 degrees to about 50 degrees or more. The inclination of the disc to the horizontal seems to facilitate separation of the non-magnetic cans.

To aid in the separation of magnetic and non-magnetic materials on the separator disc 26, a plurality of magnetic means or devices 40 are suitably operatively secured to the lower surface or under surface of this disc 26. Usually such magnet members 40 and their magnetic fields extend generally radially of the disc 26 and they are spaced both from the rotary center of the disc and also from the periphery of the disc. The disc 26 also has a guide means 42 operatively associated therewith and this guide means usually is of a v-shape in horizontal section and it is suitably positioned as by arms or bars 44 on the frame 32 to operatively position the shaft 28 for the separator disc at a desired angle to the vertical. Actually I desire to control the angle that the separator disc 26 makes with the horizontal, but this angle can likewise be measured in relation to the angle of the shaft 28 with the vertical. It has been found that the apparatus of the invention functions very effectively with the angle of the separator disc with the horizontal being anywhere from about 0 degrees to about 80 degrees whereby the shaft itself makes an angle of up to 80 degrees with the vertical. A combination of rotating speed, creating centrifugal force, and the angle alpha comprise an important part of the invention, since the non-ferrous cans tend to leave the disc at the bottom or low point on the disc, while ferous items are held onto the disc until the item is swept off by the leg 50.

As previously indicated, the guide means 42 are of a v-shape in horizontal section and such guide means has an apex 46 and has the two diverging arms 48 and 50 defining the apex. This guide and the apex thereof has the support shaft 28 for the disc receive therein adjacent the apex angle, as indicated in FIG. 2.

The position of the arm 48 is critical in that all items deposited on the disc by the crusher or other means are moving in a direction opposite to the rotation of the disc. Hence, the deposited items rotate, at first, more slowly than the disc, providing a means whereby each item actually passes into the field of at least one magnet. If it is ferrous, the item is gripped by the magnet and held affixed to it until the item is swept off the magnet by the arm 50.

A guide plate 31 may be positioned around a portion of the periphery of the disc 30 to aid in preventing cans from being knocked off the disc prematurely.

FIG. 2 indicates by arrow 52 the direction of rotation of the disc whereby the arm 48 can be considered the upstream leg of the guide means and the leg 50 is the downstream arm of the guide means. These arms, as FIG. 2 shows, extend what can be considered to be generally in a radially direction of the disc but yet they are offset from the center of the disc and include the shaft within the apex of the diverging legs and in which area of the disc no cans normally are associated. This offset is important because the arm 50 will not remove a ferous object from the disc unless the angle between the magnets and the arm is carefully established. Otherwise the ferous item will jump from magnet to magnet and not leave the disc.

The motor 38 can be adjusted so as to drive the separator disc at a desired rate of speed for throwing off non-magnetic cans or articles as soon as they are deposited on to the surface of the disc. Whereas, the magnetic material articles are attracted by the magnetic members 40 and are retained on the upper surface of the disc. As the disc rotates, however, it will be seen that these crushed cans are brought into engagement with the downstream arm 50 and as the disc rotates the cans are progressively moved in a radially outwardly direction and ultimately are separated from the top surface of the disc. To obtain this separation action, it is necessary that the strength of the magnets be correlated with the size of the disc and the weight of the articles processed. Also, the stripping action for cans made from magnetic material is also controlled to a great extent by the angle at which the separator disc 26 is set with the horizontal.

Normally, the magnetic members 40 must be spaced from the periphery of the disc so that metallic material cans when they are stripped from the peripherial top surface of the disc do not just get moved around and get attracted to the magnet members underneath of the disc.

It will be seen that the crusher and its chute 24 will deposit the crushed cans onto this disc 26 preferably adjacent the upstream leg 48 but care should be taken to drop or deposit no articles to be processed in the apex or angle formed by the diverging legs 48 and 50.

Naturally the strength and location of the magnetic members 40 can be varied depending upon the size and diameter of the disc 26 and depending upon the speed of rotation of such separator disc. The articles 21 made from aluminum will drop off the disc 26 substantially as soon as deposited thereon and can be collected in any suitable container or storage member shown at 54 in FIG. 1. Then the cans made from magnetic material will be thrown from the separator disc later in the revolution thereof and such cans are indicated at 55, which can be collected in any suitable recepticle for being weighed, stored or other action as desired.

The lower edge of the guide means 42 is positioned immediately adjacent the upper surface of the separator disc, as shown in FIG. 3. The angular relation of the downstream leg 50 to the rotation of the disc causes crushed magnetic cans to be engaged by such leg 50 and be moved generally radially of the disc by rotation of the disc as the article remains attracted to the disc by the nearest magnet 40. But such movement ends with the can having a centrifugal force throwing it from the disc as the leg 50 causes the can to move outwardly of the disc. Such movement is aided by the leg 50 having its center end adjacent the apex 46 in advance of a radial line from the outer end of the leg to the shaft 28.

By the apparatus of the invention it is possible to avoid the use of conveyor belts as the cans being processed can be transferred or moved by an air blast from the blower 12 to be moved through the control chute 14. The cans then can move through any desired type of crusher mechanism and be dropped therefrom.

The separating action of the invention is very effectively obtained when this shaft 28 for the separator disc 26 is positioned at any angle up to about 50 degrees to the horizontal. However, the apparatus will function if the support shaft is vertical and the disc in turn is in a horizontal plane. But, to obtain satisfactory separation between the magnetic material articles and non-magnetic material articles when the disc is horizontal, then the disc must be rotated faster than when the disc is positioned at an angle to the vertical. As the angle of the disc to the horizontal increases then the non-magnetic members fall off more readily and a slower rotary speed for the disc will suffice. It is preferred to use this disc at an angle of between about 30 to 35 degrees with the horizontal and this obtains a very effective separation action.

The cans or articles 21 falling into the storage member 54 may be collected and weighed therein as desired and other known acts or functions can be performed thereon, usually followed by being blown through a duct 56 by a blower 58 to a storage area.

In making the apparatus 10 preferably the frame 32 is separately made up from suitable angle bars to provide a stable open frame. Then the various other units forming the operative portions of the apparatus are added to provide a rapid acting low maintenance, compact operative unit.

The design of the modular unit 10 is such that the unit can be mounted in reverse position with no change in design. In reverse position, the modular unit can then deposit the rejected steel cans outside the storage housing (or shell). While in a regular position, it rejects and stores the steel cans internally of the shell. This option is desirable in certain communities which require that the rejected cans be returned to the operator. On the other hand, internal storage permits greater environmental control of the rejected cans.

Another advantage of the compact, modular design of this invention, which is made possible by the magnetic disc and is not possible with the long conveyors presently in use by other systems, is the great amount of space that is saved by the unit. This space saving permits much more storage in the housing, sometimes two to three times that of other units. Furthermore, the modular design creates a compact package for shipping. In those cases where the housing is built on location, the modular unit can be shipped by itself. The compactness of the modular unit takes as little as one-third the space of other units, because of the way the magnetic disc unit can be integrated into the rest of the design, a feature that is difficult to accomplish with large belt conveyor systems found in other types of units.

While in accordance with the patent statutes, a preferred embodiment and best mode has been presented, the scope of the invention is not limited thereto, but rather is measured by the scope of the attached claims.

What is claimed is:

1. A magnetic can separator where means drop crushed cans onto a mechanism comprising:

a non-magnetic rotary separator disc having a top and a lower surface, a plurality of magnetic members secured to the under surface of said disc in circumferentially spaced relation, a v-shaped guide means secured adjacent to and above the top surface of said disc for engaging any crushed cans thereon, said guide means having an apex and two diverging legs forming said apex that has the center of said disc included therein, said legs extending generally radially of said disc to the periphery of said disc, and means for rotating said disc whereby when crushed cans are deposited on said disc externally of said guide means and its apex non-magnetic cans are thrown therefrom substantially immediately and magnetic cans move with said disc but are progressively stripped therefrom by said guide means.

2. A magnetic can separator as in claim 1 where a support shaft engages said disc and positions it at an angle to the vertical of up to about 50 degrees.

3. A magnetic can separator as in claim 2 where said legs extend beyond the periphery of said disc and where said guide means has an upstream leg and a downstream leg and the cans are deposited on said disc adjacent said upstream leg but externally of the apex of said guide means.

4. A magnetic can separator where means drop crushed cans onto a mechanism, comprising:

a non-magnetic separator disc having a top and a lower surface, means postioning said disc for rotation, a plurality of magnetic members secured to the under surface of said disc in circumferentially spaced relation, said magnetic members extending generally radially of said disc and being spaced from both its center and its periphery, a v-shaped guide means secured adjacent to and above the top surface of said disc for engaging any crushed cans thereon, said guide means having two diverging legs forming an apex that has the center of said disc included therein, said legs extending generally radially of said disc and terminating beyond the periphery of said disc, and means for rotating said disc whereby when crushed cans are deposited on said disc externally of said guide means but adjacent its apex non-magnetic cans are thrown therefrom substantially immediately and magnetic cans rotate with said disc but are progressively stripped therefrom.

5. The magnetic can separator as in claim 4 where said means positioning said disc, include a support shaft which is positioned at an angle to the vertical of about 30 degrees.

6. A magnetic can separator where means drop crushed cans onto a mechanism, comprising:

a non-magnetic separator disc having a top and a lower surface, means for positioning said disc, a plurality of magnetic members secured to the under surface of said disc in circumferentially spaced relation for attracting magnetic cans and retaining them on said disc, a guide means secured adjacent to and above the top surface of said disc for engaging any crushed cans thereon, said guide means having a leg extending generally radially of but offset from the center of said disc and terminating beyond the periphery of said disc, and means for rotating said disc whereby when crushed cans are deposited on said disc upstream of said guide means non-magnetic cans are thrown therefrom substantially immediately and the magnetic cans move with said disc but are stripped therefrom by said leg.

7. A magnetic can separator as in claim 6 where said means positioning said disc, include a support shaft which is positioned at an angle to the vertical of up to about 50 degrees and where the cans are deposited on said disc at least about 90 degrees upstream of said leg.

* * * * *